United States Patent [19]

Vecchia

[11] 3,941,897

[45] Mar. 2, 1976

[54] PROCESS FOR CONTINUOUS PARAFFINING OF YARNS

[75] Inventor: Gino Dalla Vecchia, Santorso, Italy

[73] Assignee: Rimar S.p.A., Trissino, Italy

[22] Filed: Mar. 25, 1975

[21] Appl. No.: 561,777

Related U.S. Application Data

[62] Division of Ser. No. 349,712, April 10, 1973, abandoned.

[30] Foreign Application Priority Data

Apr. 17, 1972 Italy ..... 23214/72

[52] U.S. Cl. ..... 427/11; 427/345; 427/428; 118/78; 118/202

[51] Int. Cl.[2] ..... Bo5G 1/06

[58] Field of Search ..... 427/11, 345, 428; 118/76, 118/77, 78, 202, 261, 246, 234

[56] References Cited

UNITED STATES PATENTS

| | | | |
|---|---|---|---|
| 2,329,034 | 9/1943 | Buck et al. | 118/246 X |
| 2,678,284 | 5/1954 | Holt, Jr. | 118/202 X |
| 2,711,132 | 6/1955 | Viscardi | 118/202 X |
| 3,288,107 | 11/1966 | Conrad | 118/234 |
| 3,661,626 | 5/1972 | Wosaba | 118/77 X |

*Primary Examiner*—John P. McIntosh
*Attorney, Agent, or Firm*—Finnegan, Henderson, Farabow & Garrett

[57] ABSTRACT

A process for the continuous paraffining of yarns in which the yarns are drawn under tension over the top of a rotating cylinder that has been coated with a layer of solidified paraffin. The cylinder then rotates back through a bath of molten paraffin to replace the paraffin removed by the yarns, the outer surface of the cylinder being cooled to a degree sufficient to solidify the paraffin before it contacts the yarns.

5 Claims, 1 Drawing Figure

PROCESS FOR CONTINUOUS PARAFFINING OF YARNS

This application is a division of Ser. No. 349,712 filed Apr. 10, 1973 now abandoned.

BACKGROUND OF THE INVENTION

The present invention relates to a process for the continuous paraffining of any kinds of yarns.

The term "paraffining" is generally used for meaning the operation by which a weaving and/or knitting yarn is, at least partially, spread or coated with a thin layer of paraffin or hydrocarbonic wax in order to improve its features of smoothness and generically of workability.

The paraffining methods and apparatus according to which the yarn slides under tension around rods or cylinders of solid paraffin are well known. Said methods and apparatus nevertheless show the inconvenience of an uneven distribution of the paraffin layer on the yarn because the paraffin viscosity cannot be modified and therefore it is easy that some parts of the yarn are coated with an excess of paraffin while others are without paraffin layer.

Another inconvenience is due to the fact that the paraffining rods must be frequently changed when the paraffin layer is worn out owing to the continuous sliding of the yarn with a subsequently waste of an important quantity of paraffin and frequent stop of the apparatus.

SUMMARY OF THE INVENTION

It is the object of the present invention to provide a process for the continuous paraffining of any kind of yarns which essentially comprises a both directions-rotatable cylinder having a variable speed, which partially dips in a melted paraffin bath maintained at a constant temperature by a thermic chamber. The advantages of said process consist in an improved flexibility of use, a more uniform and controlled paraffining of the yarn and a self-feeding of the paraffin layer such as to avoid all stops and to need no mean presence.

DETAILED DESCRIPTION OF THE PREFERRED EMBODIMENT

Figure 1:
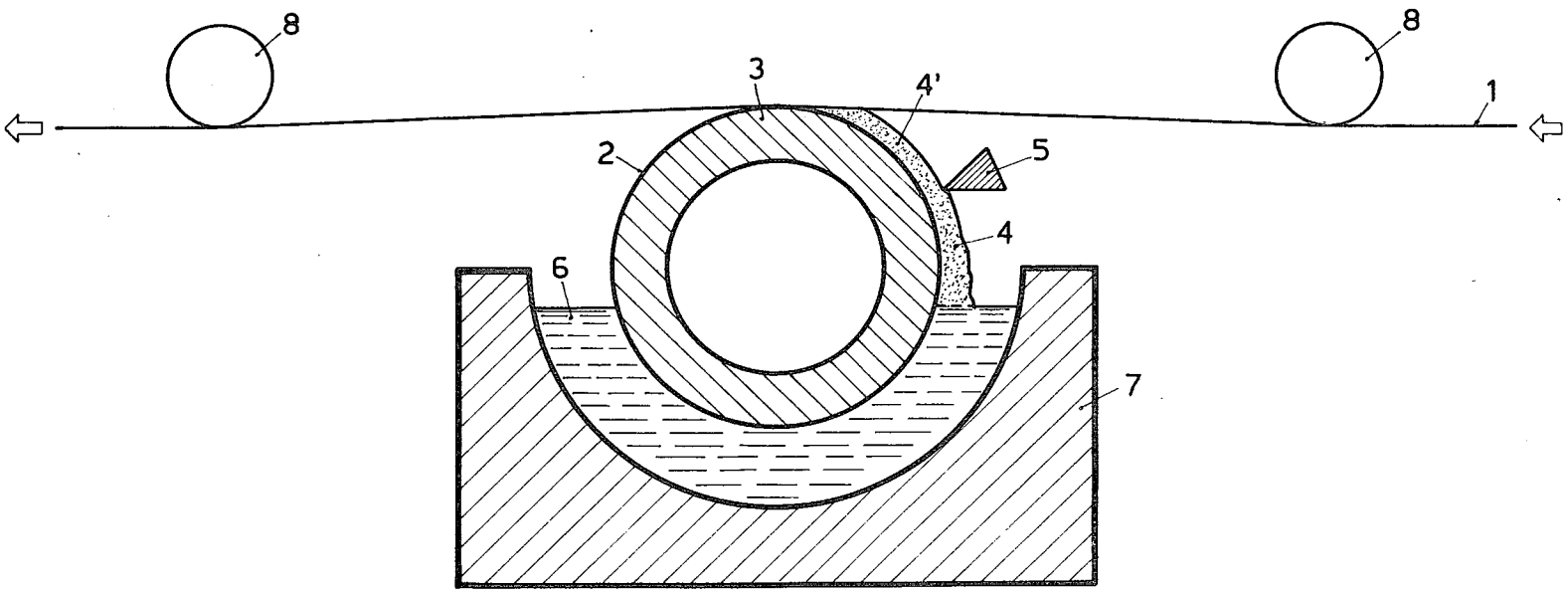

Further objects, characteristics and advantages of the apparatus according to the present invention will be evident to those skilled in the art by the following description of a preferred embodiment as shown in the annexed FIGURE of the drawings which schematically describes a cross-sectional view of the paraffining apparatus for carrying out the process of the present invention.

The yarn 1, for example after the sizing operation, being held under tension by two tightening cylinders 8, along its upper part is in contact, along a short arc of circumference, with the outer surface of a double-walled cylinder 2, driven by any kind of motor means preferably provided with a stepless speed change gear. An important portion of the outer surface of cylinder 2 is dipped in a tank filled with a paraffin bath 6 which is heat-melted by a thermic chamber provided with a thermostat. The outer surface of cylinder 2 is constantly maintained at a temperature lower than that of the paraffin bath by a cooling hollow space 3 between the two walls of the cylinder. Owing to this cooling action, the outer surface of cylinder 2 causes the viscosity of the immediately contiguous paraffin layers to increase. These layers tend to stick to the cylinder surface forming thus a more or les homogeneous coating of semi-solid paraffin 4 which is dragged out of the liquid paraffin bath 6 by the rotating cylinder and subsequently meets with a thermic scraper-evener 5 for levelling the surface by removing the excess of surface layers.

The evened paraffin layer 4', while continuing its rotative movement dragged by cylinder 2, finally meets with the yarn to be paraffined 1 preferably having a feeding speed that is faster than the rotation speed of the paraffining cylinder 2 whereby the paraffin is drawn by friction.

The possibility of varying the rotation speed of the cooled cylinder and of reversing the rotation sense as well as the possibility of varying accordingly the temperature of the paraffin bath and/or that of the cooling circuit of the cylinder consent a wider range of use of the paraffining cylinder. In fact by appropriately combining the above-mentioned parameters and modifying, if desired, the distance of the scraper 5 from the outer surface of cylinder 2 it will be possible to pass in a substantially stepless way from a thin layer of paraffin having a very low viscosity to a thick, almost solid paraffin layer, according to the kinds of yarns to be paraffin treated and to the required percentages of applied paraffin.

It is obvious that changes and/or modifications may be brought by those skilled in the art without departing from the spirit and scope of the present invention.

What I claim is:

1. A process for the continuous paraffining of yarns which comprises maintaining a bath for molten paraffin, rotating a cylinder mounted on a horizontal axis in a position above the bath to cause a bottom portion of the circumference of the cylinder to be submerged into said bath so that a molten layer of paraffin is deposited on the cylinders' circumference, cooling the circumference of the cylinder sufficient to solidify the molten paraffin layer before said portion of the circumference reaches the top of its rotational path, drawing the yarns under tension over a short arc of the top of the cylinder and in frictional contact with the solidified paraffin layer on the rotating cylinder whereby the yarns are rubbed with a coating of paraffin and the paraffin removed from the cylinder by said rubbing is replaced as the cylinder rotates back through the molten bath.

2. The process of claim 1, wherein the yarns are fed over the cylinder at a speed greater than the rotational speed of the cylinder.

3. The process of claim 2 wherein the cylinder rotates in the same direction as the direction of travel of yarn.

4. The process of claim 2 wherein the cylinder rotates in the opposite direction from the direction of travel of the yarns.

5. The process of claim 1, including leveling the height of the solidified paraffin above the outer surface of the cylinder to a predetermined thickness before the paraffin layer comes in contact with the yarns.

* * * * *